US005483122A

United States Patent [19]

Derbenev et al.

[11] Patent Number: 5,483,122

[45] Date of Patent: Jan. 9, 1996

[54] TWO-BEAM PARTICLE ACCELERATION METHOD AND APPARATUS

[75] Inventors: Yaroslav S. Derbenev, Ann Arbor, Mich.; Yue-Ying Lau, Potomac, Md.; Ronald M. Gilgenbach, Ann Arbor, Mich.

[73] Assignee: Regents of the University of Michigan, Ann Arbor, Mich.

[21] Appl. No.: 198,474

[22] Filed: Feb. 18, 1994

[51] Int. Cl.[6] ..... H05H 7/06

[52] U.S. Cl. ..... 315/5.140; 315/5.42; 315/500; 315/505

[58] Field of Search ..... 315/5.41, 5.42, 315/5.13, 5.14, 5.15, 5.16, 4, 5, 500, 505; 313/359.1, 360.1; 328/227, 233

[56] References Cited

U.S. PATENT DOCUMENTS

| | | | |
|---|---|---|---|
| 3,571,642 | 3/1971 | Westcott | 315/5.42 X |
| 3,887,832 | 6/1975 | Drummond et al. | 328/233 X |
| 4,143,299 | 3/1979 | Sprangle et al. | 315/5.41 |
| 4,215,291 | 7/1980 | Friedman | 315/5.41 |
| 4,570,103 | 2/1986 | Schoen | 315/5.41 |
| 4,583,025 | 4/1986 | Adler et al. | 315/5.41 X |
| 4,780,647 | 10/1988 | Friedman et al. | 315/5.41 |

FOREIGN PATENT DOCUMENTS

| | | | |
|---|---|---|---|
| 25999 | 11/1940 | Japan | 328/233 |

*Primary Examiner*—Benny T. Lee
*Attorney, Agent, or Firm*—Brooks & Kushman

[57] ABSTRACT

Method and apparatus for accelerating charged particles in a compact two-beam accelerator including a high voltage diode which generates an annular intense electron beam and a pencil-shaped secondary beam. The annular beam is modulated and functions as a driver beam for the secondary beam. A focusing magnetic field created by external focusing magnetic field coils adjusts the radius of the annular beam within a plurality of resonant cavity structures of an accelerating portion of the accelerator such that the phase slippage of the secondary beam, with reference to the co-propagated driver beam, is corrected. Correction of the phase slippage results in a secondary beam that is continuously accelerated. The external magnetic field also controls the energy of the secondary beam. Such high energy charged particles are useful in a wide variety of applications, such as medical radiation therapy, sterilization of medical equipment, industrial materials processing, inspection and industrial ion implantation.

20 Claims, 4 Drawing Sheets

Fig. 3a
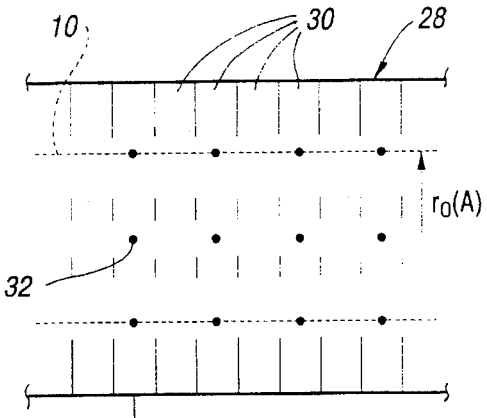
Fig. 3b
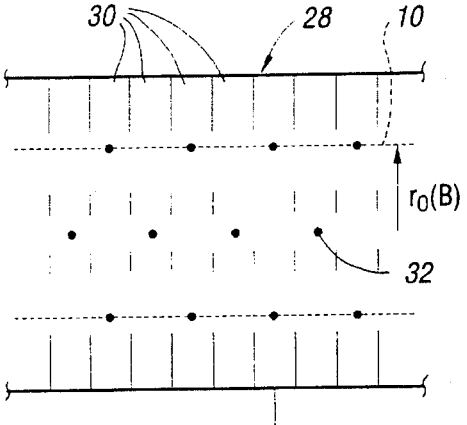
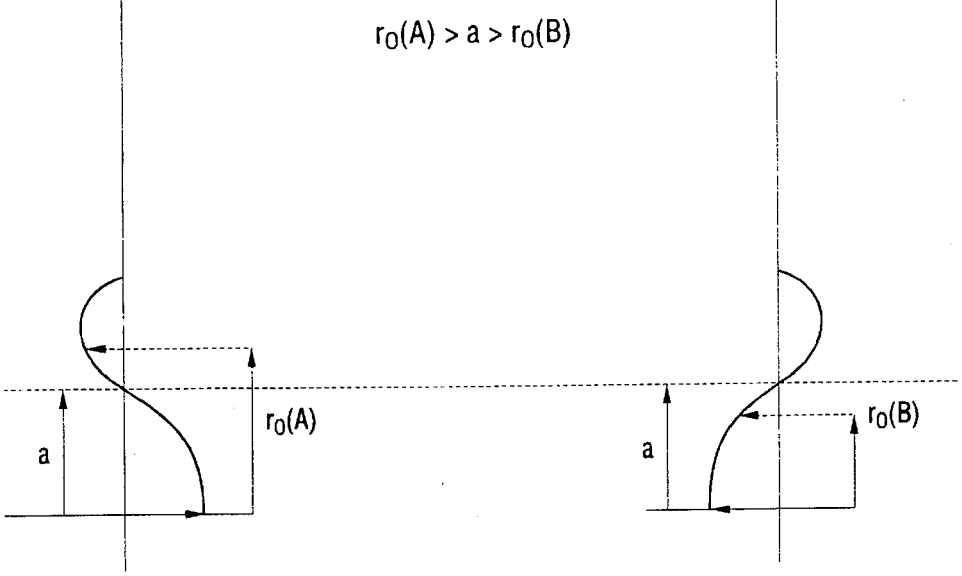
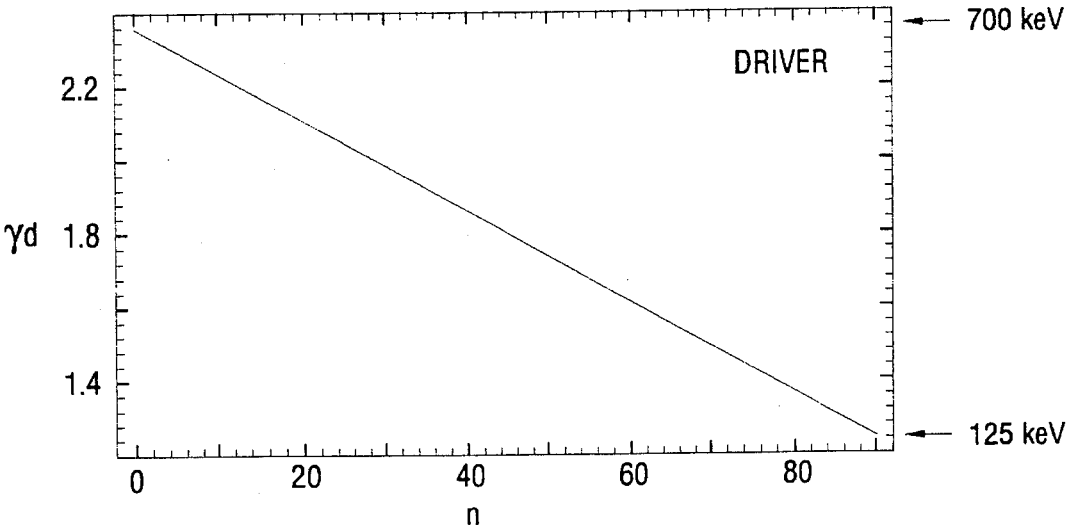
Fig. 4a

TWO-BEAM PARTICLE ACCELERATION METHOD AND APPARATUS

This invention was made with Government support under Grant N000014-91-J-1941 awarded by the Department of the Navy. The government has certain rights in the invention.

TECHNICAL FIELD

This invention relates to methods and apparatus for accelerating particles to high energies and, in particular, to two-beam acceleration methods and apparatus.

BACKGROUND ART

There are many methods and apparatus to accelerate charged particles (such as electrons, protons, and ions) to high energies. One such apparatus is known as a two-beam accelerator (TBA).

There are three different types of TBA's. Although their operating parameter regimes and the principle of operations are very different, they share one common feature: they all employ a high current electron beam (known as the driver beam or primary beam) to accelerate a low current beam (known as the secondary beam or the accelerated beam) to high energies.

The first type of TBA was proposed by Voss and Weiland. In this TBA, the primary beam consists of rings of electrons. These electron rings propagate near the outer wall of the accelerating structure. They generate an electromagnetic wakefield in a transient manner. This wakefield first propagates radially outward, toward the outer wall where it is reflected. Upon reflection, the electric field polarity of the wakefield reverses. As this reflected wakefield propagates radially inward, its amplitude increases geometrically, and is used to accelerate an on-axis secondary beam. This method of acceleration relies on the transient excitation and is not tuned to the resonant cavity mode. When the acceleration scheme is extrapolated to the lower energy regime of practical importance, it does not provide phase focusing for either the primary or the secondary beam.

The second type of TBA employs a highly relativistic electron beam as a driver. The beam's energy is converted into the microwave region of the electromagnetic spectrum through a klystron mechanism. The microwaves thus generated are piped into a separate accelerating structure to drive the secondary beam. This accelerator is not compact because a high energy beam from a linear induction accelerator is used as the driver. Since the primary beam is already very energetic, to modulate such a beam requires multiple cavities, extending over a substantial distance. To generate sufficient radio frequency (rf) power, and then to transport this rf into the accelerating structure, requires a complicated rf waveguide structure. The beams occupy separate structures.

The third type of TBA uses a modulated intense relativistic electron beam (MIREB) and is disclosed in U.S. Pat. No. 4,780,647 to Friedman. The modulated beam is terminated at a single gap, at which the entire available power of the primary beam is converted into rf power, which is delivered to a separate accelerating structure that houses the secondary beam. This device makes use of the fact that intense relativistic electron (IREB) (<1 MeV) are easily modulated by microwaves from a magnetron. However, the action on the intense beam by a single gap leads to violent and uncontrollable power conversion on the one hand, and the formation of virtual cathodes on the other. In addition, it does not provide phase focusing of the secondary beam. The primary beam and the secondary beam also occupy separate structures.

The U.S. Pat. No. to Friedman, 4,215,291, discloses a collective particle accelerator including an IREB generator. A secondary electron beam propagates in a direction opposite the driver electron beam.

The U.S. Pat. No. to Schoen, 4,570,103, discloses a particle beam accelerator which requires an intense laser.

Summary of the Invention

An object of the present invention is to provide a two-beam acceleration method and apparatus which utilizes a modulated intense electron beam as a driver beam and provides phase focusing and energy tunability in a secondary beam, as well as phase focusing for the driver beam.

Another object of the present invention is to provide a two-beam acceleration method and apparatus wherein power is converted from the driver beam to the secondary beam in a gentle and controllable fashion.

Still another object of the present invention is to provide a two-beam acceleration method and apparatus wherein the driver beam and the secondary beam occupy the same accelerating structure to eliminate the need for extensive microwave structures.

A still further object of the present invention is to provide a two-beam acceleration method and apparatus wherein the driver beam has a relatively low energy which is more easily modulated and which allows the accelerator to be compact.

In carrying out the above objects and other objects of the present invention, a two-beam acceleration method is provided. The method includes the steps of generating a high power intense relativistic driver beam, generating a secondary beam and modulating the driver beam at a predetermined frequency to produce a modulated driver beam. The method also includes the steps of providing an accelerating device having a center line and phase-focusing capability and copropagating the modulated driver beam and the secondary beam through the accelerating device so that the modulated driver beam has a radius, $r_0$, with respect to the center line. Finally, the method includes the step of adjusting the radius, $r_0$, of the modulated driver beam in the accelerating device so that the modulated driver beam accelerates the secondary beam continuously in a controlled fashion.

Preferably, the step of adjusting includes the step of generating a focusing magnetic field wherein the focusing magnetic field also controls the energy of the secondary beam.

Also preferably, the accelerating device includes a plurality of resonant structures which define cavities and wherein the method further includes the step of electromagnetically decoupling the cavities.

Still further in carrying out the above objects and other objects of the present invention, apparatus is provided for carrying out the steps of each of the above methods.

The advantages of to the use of the method and apparatus of the present invention are numerous. For example, A charged particle secondary beam can be accelerating continuously over a long distance. This is achieved mainly by a judicious adjustment of the driver beam's annular radius. This adjustment may be conveniently provided by an external magnetic field.

The degree of acceleration, and therefore the output energy in the secondary beam, may also be controlled by appropriate adjustments of the driver beam's radius along the accelerator's axial direction, by external magnetic field coils.

The conversion of driver beam energy to accelerated secondary beam energy does not require extensive radio frequency structures.

The method and apparatus make use of the efficient modulation of the intense relativistic electron beam.

Conversion of driver beam power to secondary beam power is achieved in a distributed and controllable manner. It is spread out over multiple gaps. Consequently, electrical breakdown and formation of virtual cathodes by the primary beam are less likely to occur.

The apparatus is compact compared with other TBA's. The method and apparatus provides a convenient transformation (in energy) for the entire class of pulse-power systems.

Mode competition is far less serious than in many other microwave sources (such as gyrotrons that have been proposed for high energy acceleration).

Both ions and electrons may be accelerated. Phase focusing for both secondary and driver beams are provided.

The above objects and other objects, features, and advantages of the present invention are readily apparent from the following detailed description of the best mode for carrying out the invention when taken in connection with the accompanying drawings.

BRIEF DESCRIPTION OF THE DRAWINGS

FIG. 3*a* is a schematic diagram illustrating the position of the primary beam radius $r_0$ ($r_0$>a) for secondary beam acceleration when both beams enter the cavity at the same phase;

FIG. 3*b* is a schematic diagram illustrating the position of the primary beam radius $r_0$ ($r_0$<a) for secondary beam acceleration when both beams enter the cavity at 180° phase apart;

FIG. 4*a* is a graph of energy versus distance of the driver beam illustrating the evolution of the relativistic mass factors when the driver beam radius, $r_0$, is constant;

BRIEF DESCRIPTION OF THE BEST MODE

Figure 1:
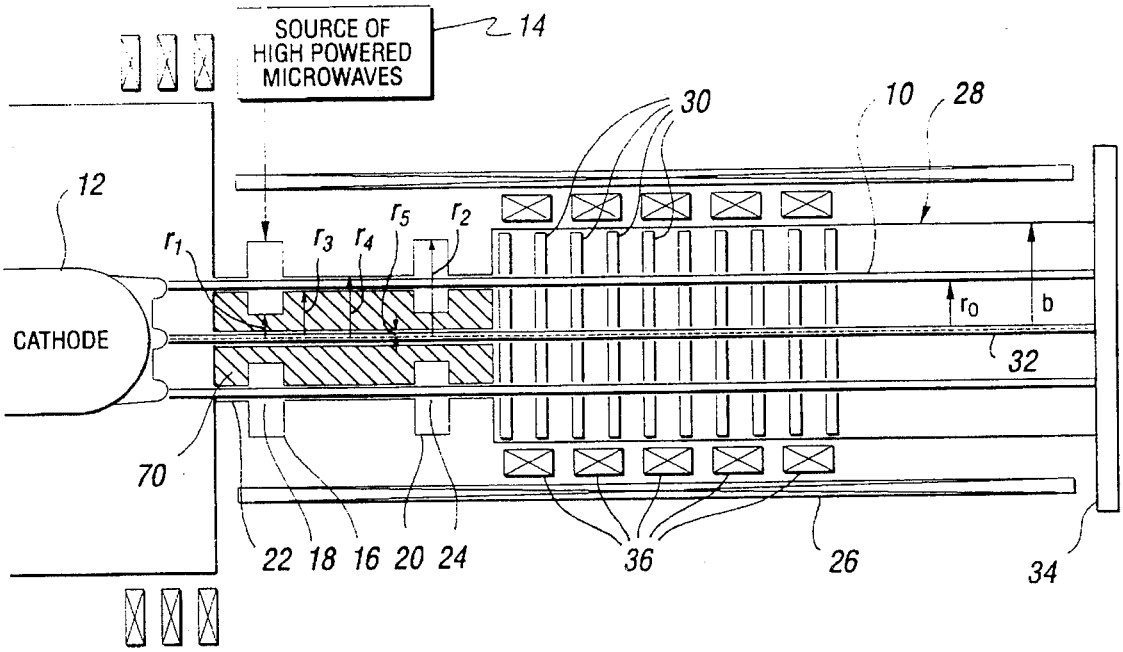
FIG. 1 is a schematic diagram of a two-beam accelerator illustrating the method and apparatus of the present invention.

Referring now to the drawing figures, there is illustrated in FIG. 1 a two-beam accelerator (TBA) constructed in accordance with the present invention. An annular electron beam 10 is generated by a high voltage diode 12. Upon leaving the diode 12, the annular driver beam 10 passes through a coaxial drift tube 22 with an inner region 70. The inner radius of the drift tube 22 is $r_3$ and the outer radius is $r_4$. The inner region 70 extends radially from a radius, $r_5$, to a radius, $r_3$. The beam 10 is modulated by an external microwave source 14 which is fed into a coaxial cavity 16. The inner radius of the cavity 16 is $r_1$, and the outer radius is $r_2$. Both $r_1$ and $r_2$ are chosen so that the resonant frequency of fundamental TM mode in the cavity 16 is identical to the frequency, ω, supplied by the microwave source 14. This resonance enables an AC gap voltage to be set up at gap 18, which modulates the primary beam 10.

A second coaxial cavity 20 is inserted downstream of the drift tube 22 to strengthen this current modulation. This second cavity 20 is undriven but is tuned to the same frequency of the first cavity 16 so that a strong voltage is induced across a gap 24. After exiting the second cavity 20, the beam 10 is highly modulated and is used as the driver beam in the TBA. The primary beam 10 is guided by an external magnetic field provided by a field coil 26.

Figure 2:
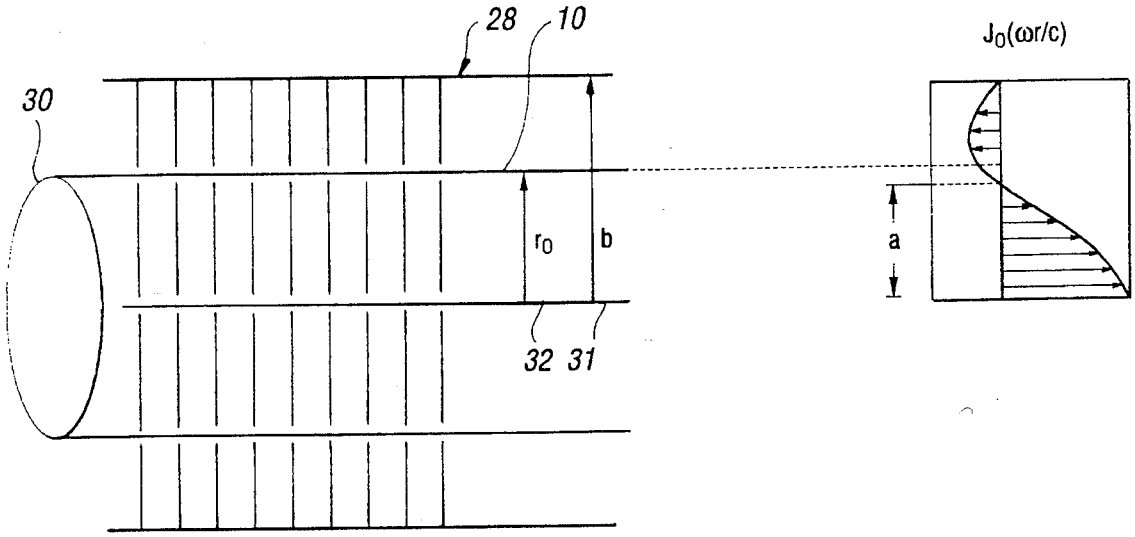
FIG. 2 is a schematic diagram of the accelerator portion of the apparatus of FIG. 1 and the rf electric force profile of the TM020 mode.

The modulated primary beam 10 is made to pass through an accelerating structure, generally indicated at 28, which consists of a series of cylindrical pillbox cavities 30. In the preferred embodiment, the radius of each pillbox as illustrated in FIG. 2 is b=5.52 c/ω, where c is the speed of light and ω is the angular frequency of the rf current on the primary beam 10. Thus, the rf current excites the TM020 mode of the pillbox cavities 30. The annular beam 10, when it enters the accelerating structure 28, has a radius, $r_0$, in the vicinity of the rf electric field-null of the TM020 mode, which is located at a radius, a=2.405 c/ω from a center line or axis 31, as illustrated in FIG. 2.

As illustrated in FIG. 2, a secondary beam 32 is a pencil beam coincident with the center axis 31 of the accelerating structure 28. It carries a modulated current at frequency ω, and is to be accelerated. When the secondary beam 32 enters a cavity 30 with the same phase as the primary beam 10, the secondary beam 32 is always accelerated while the primary beam 10 is always retarded, provided that the primary beam radius, $r_0$, is larger than radius, a, as illustrated in FIG. 3*a*. In this case, the rf electric field has opposite polarity at $r=r_0$ and at r=0. Being much more intense, the primary beam 10 excites the TM020 cavity mode whose rf electric field always slows down the primary beam 10. The kinetic energy lost by the primary beam 10 is converted into rf energy of each cavity 30, which in turn accelerates the secondary beam 32. The beams 10 and 32 are terminated at a beam intercept 34, as illustrated in FIG. 1, which may represent a target, or a beam dump, or an energy spectrometer, or some combination thereof.

Figure 4B:
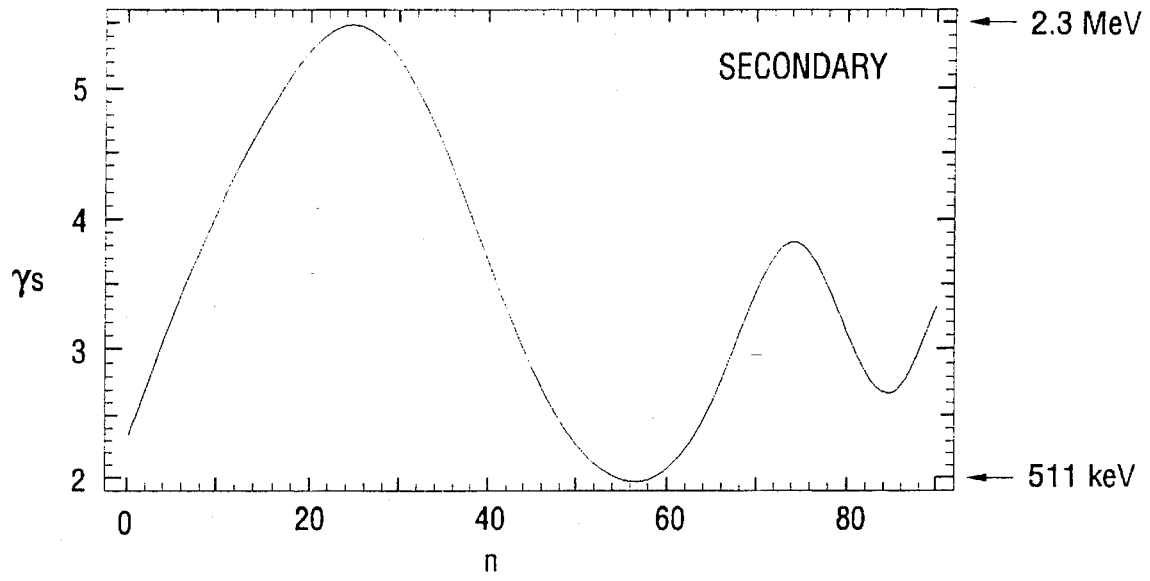
FIG. 4*b* is a graph of energy versus distance of the secondary beam also illustrating the evolution of the relativistic mass factors when the driver beam radius, $r_0$, is constant.

The acceleration of the secondary beam 32 cannot continue indefinitely because further downstream, the phase of the secondary beam 32 will be different from the phase of the primary beam 10 when they both enter the same cavity 30 downstream, as illustrated in FIG. 3*b*. This is the well-known phenomenon of phase slippage in accelerators and its effect is shown in the simulation illustrated in FIGS. 4*a* and 4*b*. FIG. 4*a* shows the continuous deceleration of the primary beam 10 an initial energy of 700 keV to a final energy of 125 keV after 90 cm of propagation in the accelerating structure 28.

The secondary beam's energy evolution is shown in FIG. 4*b*, which shows that the maximum energy gain is only up to 2.3 MeV, at a location of about 24 cm into the accelerating structure 28. Further downstream, the secondary beam 32 decelerates and accelerates alternatively because of phase slippage.

To correct the phase slippage and therefore to provide continuous acceleration of the secondary beam 32, the method and apparatus of the present invention allows the radius of the primary beam 10 to change according to the following rule: when the primary beam 10 and the secondary beam 32 enter a cavity 30 with similar phase, adjust $r_0$ outside the radius, a, as illustrated in FIG. 3*a*. When both beams 10 and 32 enter the same cavity 30 with roughly 180 degrees phase apart, adjust $r_0$ inside the radius, a, as illustrated in FIG. 3*b*. This rule is more precisely defined in Equations (7) and (8) below.

The evolution of the primary beam energy and the secondary beam energy, as the beams pass through the n-th cavity, is governed by the following differential equations:

$$\frac{d\gamma_d}{dn} = -\Lambda\delta^2, \tag{1}$$

$$\frac{d\gamma_s}{dn} = -\Lambda\delta \times \cos(\theta_s - \theta_d), \tag{2}$$

where $$\Lambda = 0.0666(\omega L/c)Q(I_d/1kA) \tag{3}$$

$$\delta = J_0(\omega r_0/c) \approx -1.249(r_0 - a)/r_0, \tag{4}$$

and the evolution of the phases is governed by the following equations:

$$\frac{d\theta_d}{dn} = \frac{\omega L}{c\beta_d} = \frac{\omega L/c}{\sqrt{1 - 1/\gamma_d^2}}, \tag{5}$$

$$\frac{d\theta_s}{dn} = \frac{\omega L}{c\beta_s} = \frac{\omega L/c}{\sqrt{1 - 1/\gamma_s^2}}. \tag{6}$$

In Equation (1), $\gamma_d = 1 + W_d/mc^2$ where $W_d$ is the kinetic energy of the primary beam 10, m is the electron rest mass, and c is the speed of light, $d\gamma_d/dn$ is then the rate of change of $\gamma_d$ as the primary beam 10 passes through the nth cavity in the series of cavities 30. Parameter $\Lambda$ is defined in Equation (3), and parameter $\delta$ by Equation (4). In Equation (2), $\gamma_s = 1 + W_s/mc^2$ where $W_s$ is the kinetic energy of the secondary beam 32, $\theta_d$ and $\theta_s$ is the respective phase of the rf current of the primary and secondary beams 10 and 32 when they enter the n-th cavity. In the equation (3), L is the axial length of each cavity 30, c is the speed of light, Q is the quality factor of the TM020 mode, $I_d$ is the rf current on the driver beam 10, kA denotes kiloamperes and $\Lambda$ is the dimensionless constant that measures the strength of cavity excitation by the primary beam 10. It is seen from Equations (4) and (2) that the secondary beam 32 will be continuously accelerated if:

$$(r_0 - a)\cos(\theta_s - \theta_d) \geqq 0. \tag{7}$$

Figure 5A:
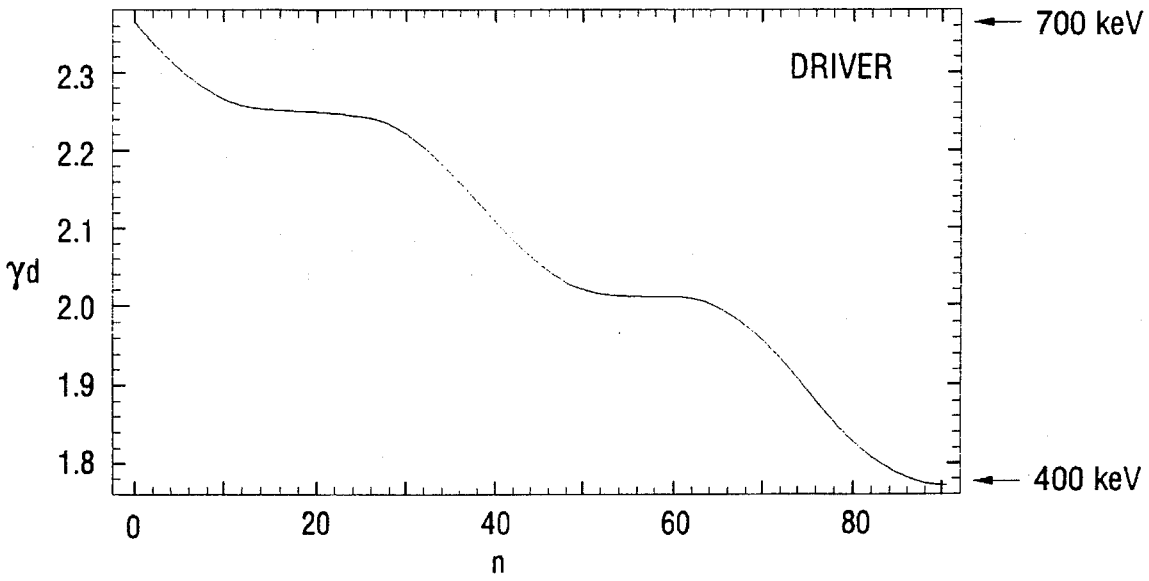
FIG. 5*a* is a graph of energy versus distance of the driver beam to be compared with the graph of FIG. 4*a* illustrating evolution of the relativistic mass factors when the driver beam radius, $r_0$, is varied to compensate for phase slippage.
Figure 5B:
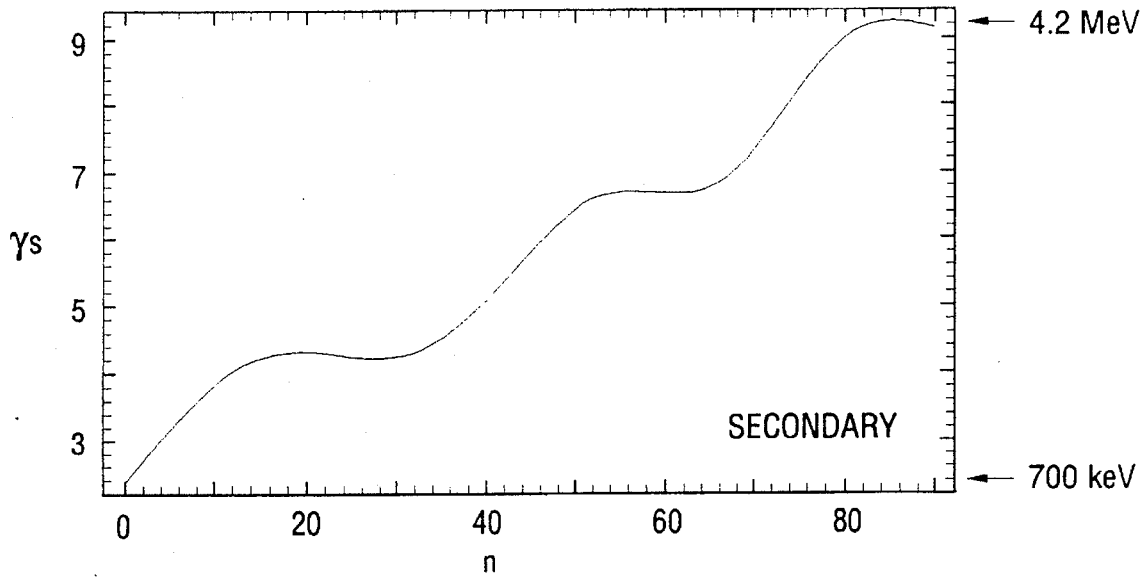
FIG. 5*b* is a graph of energy versus distance of the secondary beam to be compared with the graph of FIG. 4*b* illustrating evolution of the relativistic mass factors when the driver beam radius, $r_0$, is varied to compensate for phase slippage.

FIGS. 4*a* and 4*b* respectively show the computer simulation result when the radius of $r_0$ of the primary beam 10 is a constant. In FIG. 4*a*, the kinetic energy of the driver beam 10 decreases from 700 keV to 125 keV after propagating through ninety cavities in the accelerating structure 28 of FIGS. 3*a* and 3*b*. In FIG. 4*b*, the secondary beam 32 has its kinetic energy oscillating between 511 keV and 2.3 megaelectron volts (MeV). FIGS. 5*a* and 5*b* show the simulation results when the radius $r_0$ of the primary beam 10 is varied according to Equation (7). In FIG. 5*a*, the kinetic energy of the driver beam 10 decreases from 700 keV to 400 keV after it passes through 90 cavities. In FIG. 5*b*, the kinetic energy of the secondary beam increases steadily from 700 keV to 4.2 Megaelectron volts over the same 90 cavities, in sharp contrast to FIG. 4*b*. FIG. 5*b* shows the feasibility of continuous acceleration when the phase focusing technique according to Equation (7) is employed. In general, phase slippage can be corrected if $$k_r = \omega/v_d - \omega/v_s \tag{8}$$

where $k_r$ is the axial wave number in the annular beam radius modulation and $v_s$ and $v_d$ is the respective instantaneous velocity of the secondary beam 32 and of the primary beam 10.

One way to adjust the driver beam radius $r_0$ is through a controller or a set of external focusing magnetic field coils 36 as illustrated in FIG. 1. Varying this focusing field, one may change the driver beam radius, $r_0$. Also, the energy of the secondary beam 32 may also be controlled by this external magnetic field since the rate of energy transfer is strongly dependent on $r_0$, as indicated by Equations (1, 2, and 4).

Figure 6:
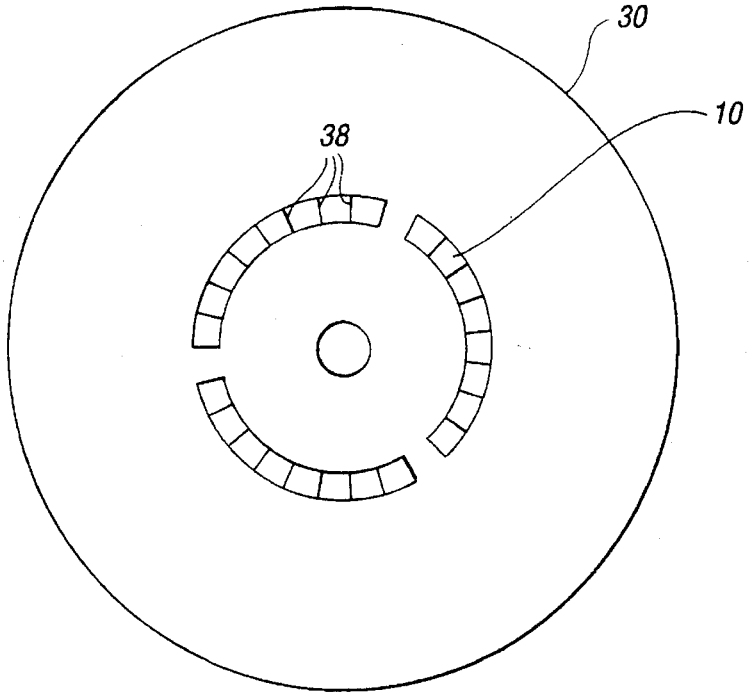
FIG. 6 is an end view of a pillbox cavity of the accelerator portion.

To discourage coupling among cavities 30, one may use a decoupler such as radial wires 38 to connect the gap through which the driver beam 10 passes, as illustrated in FIG. 6. Other conductive materials such as conducting tapes may also be used.

The following parameters were utilized to demonstrate the feasibility of the concept based on the above considerations.

| | |
|---|---|
| Frequency of modulation $\omega/2\pi$ | = 3.65 GHz |
| Diode voltage V (diode) | = 700 key |
| Driver beam rf current (Id) | = .5 kA |
| Secondary beam rf current (Is) | = 20 A |
| Separation between modulating cavities | = 10 cm |
| Primary beam mean radius ($r_0$) | = 3.3 cm |
| Primary beam radius modulation (peak—peak) | = 4 mm |
| Length of each pillbox cavity | = 1 cm |
| Radius of each pillbox cavity (b) | = 7.2 cm |
| Total number of cavities (N) | = 90 |
| Quality factor of accelerating mode (Q) | = 100 |
| Axial wavelength of $r_0$ modulation ($2\pi/k_r$) | = 75 cm |
| Secondary beam output energy | = 4.2 MeV |
| Transformer ratio (acc gradient/decel gradient) | = 12 |
| $r_1$ | = 1.56 cm |
| $r_2$ | = 5.59 cm |
| $r_3$ | = 2.8 cm |
| $r_4$ | = 3.8 cm |
| $r_5$ | = 1.0 cm |

These parameters were used to obtain the results illustrated in FIG. 5*b*.

The method and apparatus of the present invention, operating in the regime from 2–10 MeV, would have the following applications (but are not limited thereto):

1) Electron beam accelerator for medical radiation therapy and sterilization of medical equipment;
2) Industrial materials processing;
3) Industrial pulsed radiography for inspection;
4) Repetitively pulsed ion beams for industrial ion implantation.

Each of these applications will be described in greater detail below.

With respect to item 1, most major medical centers have electron beam accelerators (in the range of 10 MeV) which are used to generate intense X-rays for radiation therapy of cancer. In some cases, the electron beam can be used directly to treat cancer. These medical accelerators typically employ a very high power magnetron (2.5 MW) which drives a standing-wave accelerator. This may produce an electron beam with a large energy spread, which in turn may degrade the minimum x-ray spotsize, that can be imaged on the cancerous tumor. The two-beam accelerator invention could provide an electron beam with a lower energy spread, thereby decreasing the x-ray spotsize for radiation therapy.

Another medical application of this compact, high energy accelerator is for sterilization of medical instruments. Since the secondary, high energy beam can have currents of hundreds of amperes, the x-ray output from this two-beam accelerator in a repetitively pulsed mode can be much larger than electrostatic accelerators, which operate at low currents (milliAmps). Thus, the proposed invention would permit higher throughput of medical instrument sterilization.

With respect to item 2, electron beams are utilized in plastics manufacturing for irradiation in order to promote crosslinking of the polymers. Presently the electron beams used for this application are in the energy range of several hundred kilovolts, limited by electrostatic accelerator technology; this energy limits the thicknesses to thin sheets which are pulled past the electron beam at moderate to high speed. The proposed invention would enable higher energy electron beams (in the range of 10 MeV), thus permitting treatment of thicker plastics. In a repetitively pulsed mode, the invention would reduce insulator requirements over comparable DC accelerators. High current, repetitively-pulsed electron beams would also have application to high energy electron beam welding of thick metals, for example, for nuclear reactor vessels or ships. Heat treatment of metals might also be possible.

A third application of the two-beam accelerator would be industrial radiography. Very thick metal castings sometimes develop internal voids which cannot be easily detected. High energy x-ray radiography making use of this invention could be used to detect these voids or to detect internal cracks in large castings.

Ion beam accelerators are used extensively for ion implantation of materials. Typically, the maximum energy of ion implantation is 0.4 MeV to 2 MeV, limited by current electrostatic accelerators; this limits the ion range in typical metals. In the ion beam configuration, the two-beam accelerator could be used for high energy (1–10 MeV) ion implantation in materials; this opens up a new parameter regime in which the ions could be deposited to greater depth, providing improved bulk-properties of the material (e.g., increased strength).

While the best mode for carrying out the invention has been described in detail, those familiar with the art to which this invention relates will recognize various alternative designs and embodiments for practicing the invention.

For example, the method and system of the present invention allow:

- Operation at other frequencies, other power levels for both the primary and secondary beams, other voltages and currents, and other phases of the primary beam current and secondary beam currents when they enter the accelerating structures.
- Other radius tapering in the primary beam to control phase focusing and acceleration gradients.
- Acceleration of ions instead of electrons.
- Other cavity modes for secondary beam acceleration.
- Other cavity spacings, dimensions, geometries, quality factors, tuning of cavities, focusing magnetic fields.
- Other focusing schemes, and manipulation of structure modes for beam breakup control.
- Use radial conducting wires, or thin strips of conducting tapes, to provide electrical connection between the central part of the cavity and the outer part. This will discourage cross-talk among neighboring cavities and allow higher Q's.
- Other acceleration gradients and other accelerator lengths.
- Use of superconducting cavities, use of higher energy driver beams.
- Use of superconducting cavities and very low energy beam (<100 keV) as the driver beam. Such a low energy driver beam may carry moderate current and may operate with long pulse length as it is readily available from thermionic cathodes.
- Use of multiple pencil beams (in place of the continuous annular beam) as the driver beam. These pencil beamlets thread through small apertures that are distributed annularly. A variation would be to use several annular arcs of electrons as the primary beam.
- Use multi-stage driver beams and multi-stage configurations.
- Use of a coaxial or hollow drift tube to modulate the primary beam.
- Use of a small diameter drift tube to modulate an initially small diameter primary beam. After this small diameter primary beam is modulated, allow it to expand into a larger radius annular beam (via a gradually weakened focusing magnetic field) before it enters the accelerating structure, and, thereafter, employ the acceleration mechanism described herein.

What is claimed is:

1. A two-beam particle acceleration method comprising the steps of:

generating a high power intense relativistic driver beam of particles;

generating a secondary beam of particles;

modulating current of the driver beam of particles at a predetermined frequency to produce a modulated driver beam of particles;

providing an accelerating device having a center line and a phase-focusing capability;

copropagating in the same direction the modulated driver beam of particles and the secondary beam of particles through the accelerating device so that the modulated driver beam of particles is substantially located along a radius, $r_0$, with respect to the center line; and adjusting the radius, $r_0$, of the modulated driver beam of particles in the accelerating device so that the modulated driver beam of particles accelerates the secondary beam of particles continuously in a controlled fashion.

2. A two-beam particle acceleration method comprising the steps of:

generating a high power intense relativistic driver beam of particles;

generating a secondary beam of particles;

modulating current of the driver beam of particles at a predetermined frequency to produce a modulated driver beam of particles;

providing an accelerating device with a phase-focusing capability and with a plurality of resonant structures which define accelerating cavities aligned along a center axis;

propagating the modulated driver beam of particles at a location substantially along a radius, $r_0$, with respect to the center axis through the accelerating cavities having a first phase therealong and to excite a predetermined mode of the accelerating cavities, an rf electric field null of the predetermined mode being located at a radius, a, with respect to the center axis;

propagating the secondary beam of particles having a second phase through the accelerating cavities along the center axis; and adjusting the radius of the modulated driver beam of particles in the accelerating device so that the radius, $r_0$, is greater than the radius, a, when the first and second phases are approximately the same and so that the radius, $r_0$, is less than the radius, a, when the first and second phases are approximately 180 degrees apart.

3. The method as claimed in claim 2 wherein the step of adjusting includes the step of generating a focusing magnetic field, the focusing magnetic field also controlling the energy of the secondary beam of particles.

4. The method as claimed in claim 2 wherein the step of modulating includes the step of forming an annular modulated driver beam of particles.

5. The method as claimed in claim 2 wherein the steps of generating includes the step of energizing a single high voltage diode.

6. The method as claimed in claim 2 wherein the step of generating the driver and secondary beams of particles includes the step of generating respective electron beams.

7. The method as claimed in claim 2 wherein the step of propagating excites the TM020 mode in the accelerating cavities.

8. The method as claimed in claim 2 wherein the step of generating the secondary beam includes the step of generating a pencil beam of particles.

9. The method as claimed in claim 2 wherein the step of generating the driver beam of particles includes the step of generating an electron beam of particles and the step of generating the secondary beam of particles includes the step of generating an ion beam of particles.

10. The method as claimed in claim 2 further comprising the step of electromagnetically decoupling the accelerating cavities.

11. A two-beam particle acceleration apparatus comprising:

a first generator for generating a high power intense relativistic driver beam of particles;

a second generator for generating a secondary beam of particles;

a modulator positioned relative to the first generator for modulating current of the driver beam of particles at a predetermined frequency to produce a modulated driver beam of particles;

an accelerator positioned relative to the first and second generator and having a center line wherein the modulated driver beam of particles and the secondary beam of particles are copropagated in the same direction through the accelerator so that the modulated driver beam is located substantially along a radius, $r_0$, with respect to the center line; and a controller positioned relative to the accelerator for adjusting the radius, $r_0$, of the modulated driver beam of particles in the accelerator so that the modulated driver beam of particles accelerates the secondary beam of particles continuously in a controlled fashion.

12. A two-beam particle acceleration apparatus comprising:

a first generator for generating a high power intense relativistic driver beam of particles;

a second generator for generating a secondary beam of particles;

a modulator positioned relative to the first generator for modulating current of the driver beam of particles at a predetermined frequency to produce a modulated driver beam of particles;

an accelerator positioned relative to the first and second generators and with a plurality of resonant structures which define accelerating cavities aligned along a center axis, the driver beam of particles being at a location substantially along a radius, $r_0$, with respect to the center axis through the accelerating cavities and having a first phase therealong, the driver beam of particles exciting a predetermined mode of the accelerating cavities, wherein an rf electric field null of the predetermined mode is located at a radius, a, with respect to the center axis and wherein the secondary beam has a second phase in the accelerator; and a controller positioned relative to the accelerating for adjusting the radius, $r_0$, of the driver beam of particles in the accelerator so that the radius, $r_0$, is greater than the radius, a, when the first and second phases are approximately the same and so that the radius, $r_0$, is less than the radius, a, when the first and second phases are approximately 180 degrees apart.

13. The apparatus as claimed in claim 12 wherein the controller includes a set of external focusing magnetic field coils positioned about the accelerator for generating a focusing magnetic field, the focusing magnetic field also controlling the energy of the secondary beam of particles.

14. The apparatus as claimed in claim 12 wherein the modulated driver beam of particles is annular.

15. The apparatus as claimed in claim 12 wherein a single, high voltage diode comprises the first and second generators.

16. The apparatus as claimed in claim 12 wherein the driver and secondary beams of particles are respective electron beams.

17. The apparatus as claimed in claim 12 wherein the predetermined mode of the resonant structures is the TM020 mode.

18. The apparatus as claimed in claim 12 wherein the secondary beam of particles is a pencil beam of particles.

19. The apparatus as claimed in claim 12 further comprising a decoupler coupled to the resonant structures for electromagnetically decoupling the accelerating cavities.

20. The apparatus as claimed in claim 19 wherein the accelerator is cylindrical and includes a gap and wherein the decoupler includes radially extending conducting wires that electrically connect the gap through which the primary beam of particles passes.

* * * * *